US007090107B2

(12) United States Patent
Buechel et al.

(10) Patent No.: US 7,090,107 B2
(45) Date of Patent: Aug. 15, 2006

(54) HAND-HELD SETTING TOOL

(75) Inventors: Johann Buechel, Sevelen (CH); Robert Jakob, Feldkirch (AT); Dionys Schalbetter, Haag (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/955,520

(22) Filed: Sep. 30, 2004

(65) Prior Publication Data

US 2005/0121487 A1 Jun. 9, 2005

(30) Foreign Application Priority Data

Oct. 9, 2003 (DE) ..... 103 46 985

(51) Int. Cl.
*B21J 15/28* (2006.01)

(52) U.S. Cl. ..... 227/8; 227/156

(58) Field of Classification Search ..... 227/10, 227/8, 9, 156; 173/8, 9, 10
See application file for complete search history.

(56) References Cited

U.S. PATENT DOCUMENTS 1,365,869 A * 1/1921 Temple ..... 227/9
3,060,435 A * 10/1962 Ivins et al. ..... 227/11
3,469,504 A * 9/1969 Neighorn ..... 92/85 R
3,988,849 A * 11/1976 Connellan et al. ..... 42/70.09
4,479,599 A * 10/1984 Conrad ..... 227/9
5,273,198 A * 12/1993 Popovich et al. ..... 227/10
5,429,291 A * 7/1995 Thompson ..... 227/10
5,465,893 A * 11/1995 Thompson ..... 227/8

FOREIGN PATENT DOCUMENTS

EP 1 498 225 * 1/2005

* cited by examiner

*Primary Examiner*—Stephen F. Gerrity
*Assistant Examiner*—Paul Durand
(74) *Attorney, Agent, or Firm*—Abelman, Frayne & Schwab

(57) ABSTRACT

A hand-held setting tool for driving in fastening elements includes a pressure probe (20) displaceable between an extended position (22) in which the setting tool (10) cannot be actuated, and an operational position (23) in which the setting tool (10) can be actuated, and a blocking member (30) displaceable by a gravity force between its release position (34) in which it is located outside of a displacement path (24) of the pressure probe (20), and a blocking position (35) in which it extends into the displacement path (24) of the pressure probe (20), blocking displacement of a pressure probe (20) into its operational position.

4 Claims, 2 Drawing Sheets

29
19
20
α
21
22
32
D1
25
D2
36
30
33
D3
26
31
35
G
18

HAND-HELD SETTING TOOL

BACKGROUND OF THE INVENTION

1. Field of the Invention

The present invention relates to a setting tool for driving in fastening elements and including a guide, a pressure probe displaceable between its extended position in, which the setting tool cannot be actuated, and its operational position in which the setting tool can be actuated.

2. Description of the Prior Art

Hand-held setting tools of the type described above can be operated with solid, gaseous, or liquid fuels or with compressed air. In the combustion-operated setting tools, the setting piston is driven by high-pressure combustion gases of a propellant. The setting piston drives fastening elements in constructional components.

For safety reason, usually, setting tools, which work with high-pressure gases, are equipped with means for sensing a press-on condition of a setting tool. The sensing means includes at least one pressure probe that projects beyond the front part of the setting tool and in which the tool outlet opening is formed. In order to be able to actuate the setting tool, the pressure probe should be displaced in its operational position by pressing the setting tool against a constructional component.

German patent DE 40 32 200 C2 discloses a pressure probe in form of a pressure pin. The pressure probe is arranged off-center (i.e., sidewise of the setting axis) on the base plate of the tool. The setting process only then can be effected when the pressure probe detects that the front part with the outlet opening correctly engages the constructional component. However, the drawback of the known setting tool consists in that an inadvertent displacement of the pressure probe can take place when the setting tool is placed, for disassembly purposes, with its back on a constructional component with the outlet opening facing upward. The inadvertent displacement of the pressure probe takes place when the pressure probe supporting spring element weared off or became broked. This can lead to the danger of an inadvertent actuation of the setting tool.

Accordingly, an object of the present invention is to provide a setting tool of the type discussed above in which the drawback of the prior art tool is eliminated and which is capable to meet high safety requirements.

SUMMARY OF THE INVENTION

This and other objects of the present invention, which will become apparent hereinafter, are achieved by providing in a setting tool of the type discussed above, a blocking member displaceable by a gravity force between a release position in which it is located outside of displacement path of the pressure probe in the probe guide, and a blocking position in which it extends into the displacement path of the pressure probe, blocking displacement of the pressure probe into the operational position.

As a result of the present invention, there is provided tool position-dependent blocking means for the pressure probe and which prevents displacement of the pressure probe into its operational position at least in a vertical position of the setting tool when the front part of the tool is spaced from a constructional component. Thereby, an inadvertent actuation of a setting tool during its disassembly is prevented. The blocking means are very simple and can be easily produced.

Advantageously, the blocking means includes a blocking member guide opening in a direction of the pressure probe guide and extending relative thereto, in the setting direction, at an angle smaller than 90°. The angular arrangement of the blocking member guide provides for a simple gravity force control. Because the blocking member guide does not extend to the pressure probe guide at a right angle, in the disassembly position of the setting tool (with the outlet opening part being spaced from a constructional component in a direction of the gravity force), the blocking member will be displaced into the pressure probe guide along an inclination surface of the blocking member guide.

Advantageously, the blocking member is formed as a ball, whereby a more rapid reaction time of the blocking means is attained. This is because a ball can be displaced along the inclination of the blocking member guide very rapidly under the action of the gravity force.

Advantageously, the pressure probe guide has a guide channel the diameter of which is smaller than the diameter of the blocking member, in particular when the blocking member is formed as a ball. This prevents displacement of the blocking member in the pressure probe guide.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
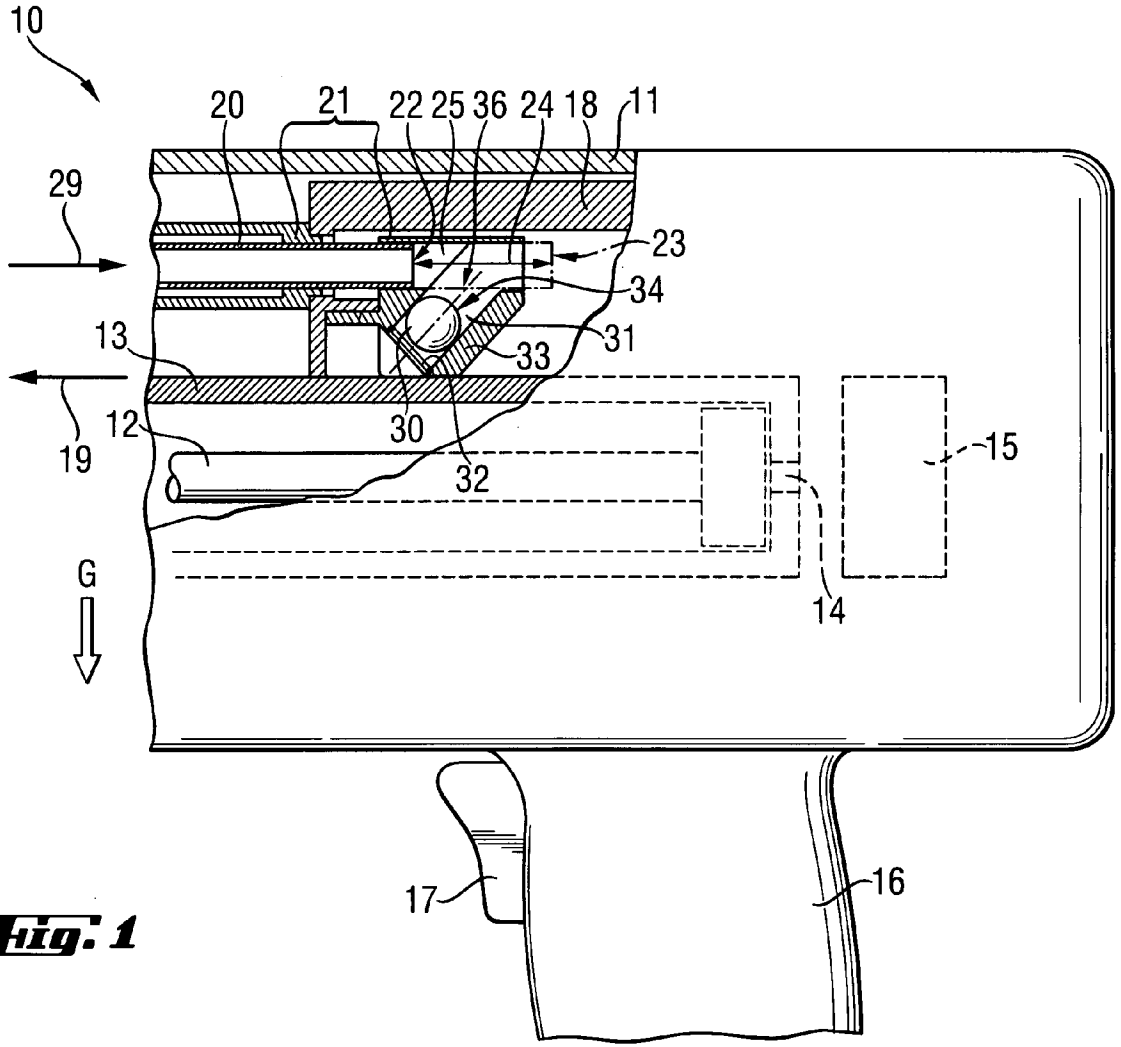
FIG. 1 a cross-sectional side view of a portion of a setting tool according to the present invention in an initial condition thereof in a horizontal position of the setting tool.

FIG. 1 shows a rear portion of a combustion-operated, hand-held setting tool 10 and which is spaced from the outlet opening of the setting tool 10. The setting tool 10 has a one-or multi-part housing 11 in which a setting mechanism is arranged. The setting mechanism includes a piston guide 13 in which a drive piston 12 is displaceable for driving fastening elements in objects such as constructional components. At the end of the piston guide 13 facing in the direction opposite a setting direction 19, there is arranged a propellant socket 14 such as a cartridge socket in which a propellant is fed. For an electronic, mechanical, or electrical ignition of a propellant located in the propellant socket 14, there is provided an ignition unit 15. For actuation of a setting process, an actuation switch 17 is provied on a handle 16 of the setting tool 10.

The setting tool 10 also includes a front part with the outlet opening (not shown) and facing in the setting direction 19. The front part adjoins the setting mechanism. The setting tool 10 further includes a pressure probe 20 that projects beyond the front part in the setting direction 19. The pressure probe 20 functions as a safety element that, i.e., interrupts or blocks an initiation of an ignition process with the ignition unit 15 when the front part with the outlet opening is not properly pressed against, e.g., a constructional component. In the embodiment shown in the drawing, the pressure probe 20 is formed as a tubular, elongate element displaceably supported in a guide channel 25 of a multipart guide 21. The guide 21 is formed in a housing element 18.

In the extended position 22 of the pressure probe 20, which is shown in FIG. 1, a setting process with the setting tool 10 cannot be carried out. Upon pressing the setting tool against a constructional component, e.g., the pressure probe 20 is displaced by a displacement path 24 in the direction 29 opposite the setting direction 19 into its actuation position 23 shown with dot-dash lines. In the actuation position 23 of the pressure probe 20, a setting process can be initiated with the actuation switch 17.

The setting tool 10 further includes a blocking member 30 formed as a ball displaceably supported in a blocking member channel 31 of a blocking member guide 33. The blocking member 30 can also be formed, e.g., as a cylindrical body.

At the end of the blocking member guide 33 remote from the pressure probe guide 21, the blocking member channel 31 is provided with a safety element 32 that prevents the blocking member 30 from falling out of the blocking member channel 31. The safety element 32 can be removed and then mounted again in order to replace the blocking member 30, In the embodiment shown in the drawing, the blocking member guide 33 and a portion or section of the pressure probe guide 21 are formed as a one-piece part 26.

The blocking member guide 33 extends in the setting direction 19 to the guide 21 of the pressure probe 20 at an, angle less than 90°. The blocking member guide 33 is so arranged in the setting tool 10 that it is aligned, at least partially, in the direction of a gravity force G in a normal operational position of the setting tool 10, i.e., when the setting tool 10 extends, as shown in FIG. 1, horizontally to the gravity force G. In this position of the setting tool 10, the blocking member 30 is held, as shown in FIG. 1, in its release position 34 in which the displacement path 24 of the pressure probe 20 is free and the probe 20 can be displaced from its extended position 22 into its operational position 23.

Figure 2:
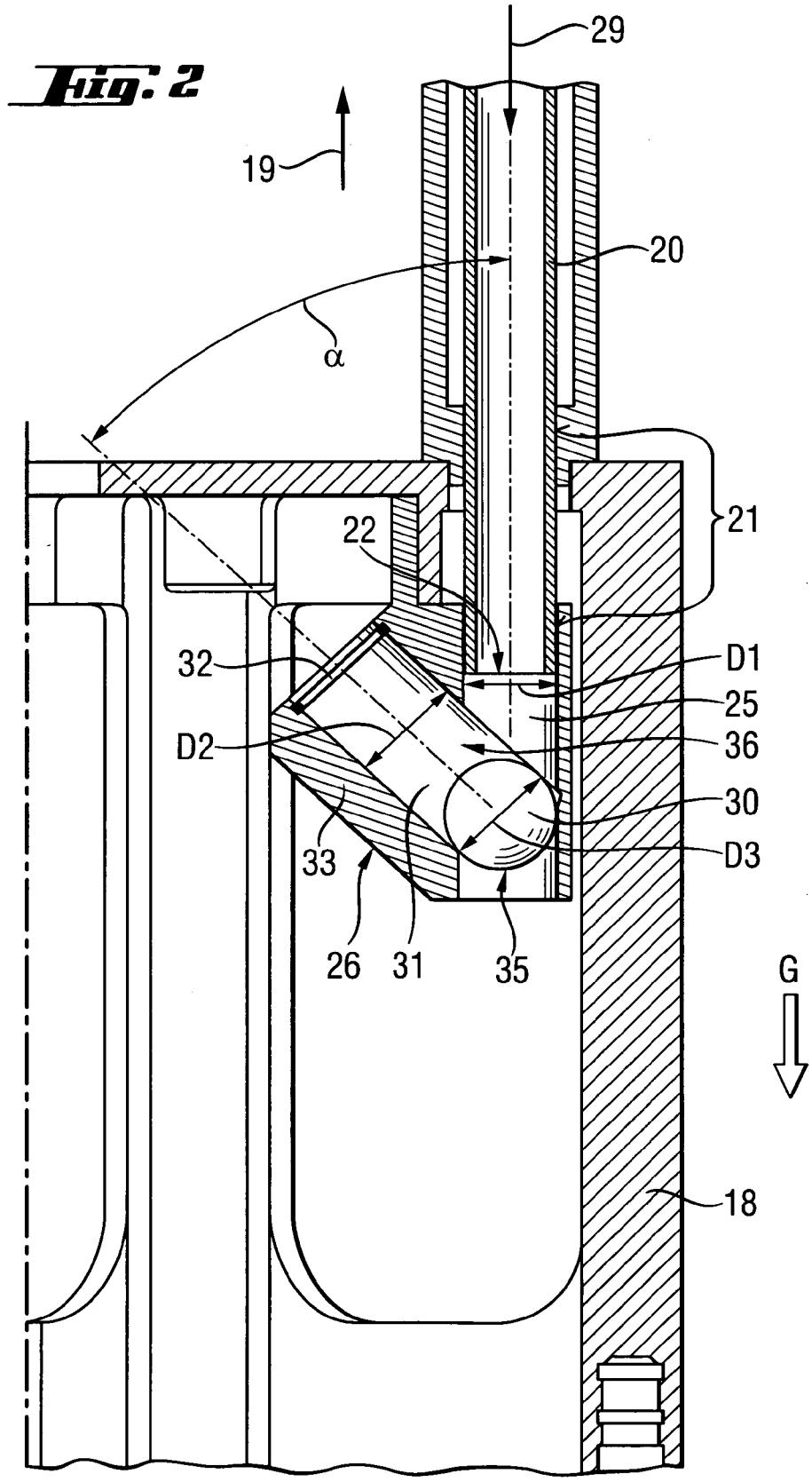
FIG. 2 a cross-sectional view of a detail of the setting tool shown in FIG. 1, with the setting tool extending parallel to the gravity force and with the outlet opening of the setting tool spaced from an object.

Then the setting tool 10 is placed in a position which is shown in FIG. 2 and in which the blocking member channel 31 with its opening 36 is aligned in the direction of the gravity force G, the blocking member 30 is displaced by the gravity force G in the guide channel 25 for the pressure probe 20 and occupies its blocking position 35. In this position of the blocking member 30, the pressure probe 20 cannot be displaced from its extended position 22 into its operational position 23, and the setting tool cannot be inadvertently actuated. The maximum inclination of the setting tool 10 during which a setting process can still be carried out with the setting tool 10, is defined essentially the angle $\alpha$ at which the blocking member guide 30 is inclined, in the setting direction 19, toward the probe guide 22.

The diameter D1 of the guide channel 25 in which the pressure probe 20 is displaced is smaller than the diameter D3 of the blocking member 30 and D2 of the blocking member channel 31. With the blocking member 30 having a diameter greater than the diameter of the guide channel 25, the displacement of the blocking member 30 by the pressure probe 20 is prevented.

Alternatively, e.g., a recess can be formed in the guide 21 into which a projection on the blocking member 30 can fall in order to prevent the displacement of the blocking member 30 by the pressure probe 20.

Though the present invention was shown and described with references to the preferred embodiment, such is merely illustrative of the present invention and is not be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held setting tool for driving in fastening elements, comprising a guide (21); a pressure probe (20) for sensing a press-on condition of the setting tool when the pressure probe is pressed against a constructional component, the pressure probe being displaceable in the guide (21) between an extended position (22) thereof in which the setting tool (10) cannot be actuated, and an operational position thereof (23) in which the setting tool (1) can be actuated; and a blocking member (30) displaceable by a gravity force between a release position (34) in which it is located outside of a displacement path (24) of the pressure probe (20) in the guide (21), and a blocking position (35) in which it extends into the displacement path (24) of the pressure probe (20), blocking displacement of the pressure probe (20) into the operational position thereof whereby an actuation of the setting tool is prevented in absence of the press-on condition.

2. A hand-held setting tool according to claim 1, comprising a blocking member guide (33) opening in a direction of the guide (21) and extending thereto in a setting direction (19) at an angle ($\alpha$) smaller than 90°.

3. A hand-held setting tool according to claim 1, wherein the blocking member (30) is formed as a ball.

4. A hand-held setting tool according to claim 1, wherein the guide (21) has a guide channel (25) having a diameter (21) smaller than a diameter (23) of the blocking member (30).

* * * * *